US007081004B1

(12) United States Patent
Puzio

(10) Patent No.: US 7,081,004 B1
(45) Date of Patent: Jul. 25, 2006

(54) BEND RADIUS FRICTION LOCK SYSTEM

(76) Inventor: Michael Puzio, P.O. Box 68, Sorrento, FL (US) 32776

( * ) Notice: Subject to any disclaimer, the term of this patent is extended or adjusted under 35 U.S.C. 154(b) by 185 days.

(21) Appl. No.: 10/803,826

(22) Filed: Mar. 18, 2004

(51) Int. Cl.
*H01R 13/62* (2006.01)

(52) U.S. Cl. ..... 439/369

(58) Field of Classification Search ..... 439/369, 439/445, 447, 457; D8/359, 358, 394; 242/400.1, 242/405.2, 405.1, 404.1, 404.3
See application file for complete search history.

(56) References Cited

U.S. PATENT DOCUMENTS

| | | | | |
|---|---|---|---|---|
| 2,204,939 | A | 6/1940 | Lyons | 173/361 |
| 2,461,427 | A | 2/1949 | Kneebone | 173/322 |
| 2,778,582 | A | 1/1957 | Arthur | 242/96 |
| 3,781,761 | A | 12/1973 | Harwood | 339/75 P |
| 4,183,603 | A | 1/1980 | Donarummo | 439/369 |
| 4,221,449 | A | 9/1980 | Shugart, Jr. | 439/369 |
| D269,065 | S | 5/1983 | Hough, Jr. | D8/356 |
| 4,440,465 | A | 4/1984 | Elliott et al. | 439/369 |
| 4,504,106 | A | 3/1985 | Fechter | 439/297 |
| 4,773,874 | A | 9/1988 | Kopeski, Jr. | 439/369 |
| 4,832,618 | A | 5/1989 | Gunderson | 439/369 |
| 4,957,450 | A | 9/1990 | Pioszak | 439/369 |
| 5,336,106 | A | 8/1994 | Osten | 439/369 |
| 5,423,693 | A | 6/1995 | Light | 439/369 |
| 5,427,543 | A | 6/1995 | Dynia | 439/346 |
| 5,514,004 | A | 5/1996 | Swanson | 439/364 |
| D372,420 | S | 8/1996 | Mendez | D8/383 |
| 5,547,390 | A * | 8/1996 | Laherty | 439/457 |
| 5,582,524 | A | 12/1996 | Sanner et al. | 439/369 |
| 5,593,312 | A | 1/1997 | McCracken | 439/369 |
| 5,695,356 | A | 12/1997 | Swanson | 439/369 |
| D401,559 | S | 11/1998 | Angell | D13/154 |
| D416,191 | S | 11/1999 | Edwards | D8/394 |
| 6,134,798 | A * | 10/2000 | Duncan et al. | 33/484 |
| 6,319,044 | B1 | 11/2001 | Stekelenburg | 439/346 |
| 6,435,389 | B1 * | 8/2002 | Sucher | 224/576 |
| D468,996 | S | 1/2003 | Sarkinen et al. | D8/356 |

* cited by examiner

*Primary Examiner*—Briggitte R. Hammond
(74) *Attorney, Agent, or Firm*—Brian S. Steinberger; Law Offices of Brian S. Steinberger, P.A.

(57) ABSTRACT

Locking devices and methods of using the devices for interlocking two, three, four or more electrical type extension cords together with each other and/or with electrical cords on appliances and tools, to one another. Versions of the devices can include side facing slots having various configurations that allow portions of the electrical cords to be wrapped around and snappably held within. Pulling the cords apart can tighten the cords into the slots. The devices can have various configurations such as being ruler shaped, fan shaped ends, fork shaped ends, and the like. Coils and springs can be located on the ends of the devices in place of the slots to also allow for the cords to be locked. Indicia ruler markings can be provided on the device so that it can be used as a measuring tool.

9 Claims, 18 Drawing Sheets

BEND RADIUS FRICTION LOCK SYSTEM

This invention relates to electric cords, in particular to devices and methods of interlocking separate electric power cords together so that the cords do not detach from one another.

BACKGROUND AND PRIOR ART

Extension cords have become very popular over the years for connecting to existing electric cords on various power equipment such as but not limited to power tools and/or appliances to remotely located electrical outlets. A common problem is that when the electric tool or appliance is moved, the extension cord has been known to disconnect from the existing electric cord. This disconnection can cause extra undesirable downtime and frustration to the user having to stop their work to reconnect the cords to one another. Additionally, the interconnecting plugs and sockets on the extension cord and/or existing power cord often become damaged since the plug prongs and/or the female sockets can become bent and no longer reliable for future use. Still furthermore, extension cords are also used for many important applications such as in medical procedures, and such, where untimely disconnections can have disastrous results. Thus, untimely power cord disconnections can be both inconvenient and even dangerous.

Solutions over the years have included it being common for users of electrical cords to tie adjoining electrical cords together in a knot at a point near the interconnection of the cord plugs. However, there are problems with tying knots in electrical cords. For example, as the cords are being pulled apart under tension, the knots can become tighter placing undue stress on the electrical wiring contained in the cords. Further, it can be difficult and time consuming to both tie and to untie, the cords from one another, as well as the knots create an unsightly appearance. Still furthermore, small and/or tight knots can cause the plugs to break off from the wire.

Various types of patents have been proposed to solve the disconnection problems. For example, U.S. Pat. No. 2,778,582 to Arthur describes a "means for holding electric cable in a coiled condition", title, that requires supporting the cable in vertically stacked loops similar to a garden hose, and does not describe, teach, nor suggest locking two or more cords together. U.S. Pat. No. 2,204,939 to Lyons describes a "combination electrical cord reel and outlet plug", title, that locks a plug to a cord by wrapping the cord end about a reel, and does not describe, teach, nor suggest locking two cords together.

Other devices have used plural type slots on opposite sides of an elongated member. See for example, U.S. Pat. No. 3,781,761 to Harwood; U.S. Pat. No. 5,423,693 to Light; Des. 416,191 to Edwards; and D 468,996 to Sarkinen et al. However, each of these devices requires the user pass the cord down and up and/or up and down along a single column of side extending slots. Although there is some tension in this fastening arrangement, it is possible that some cords, such as small diameter cords can be pulled out of these single column of slots if pulled hard enough apart. Also, cords having diameters smaller than the slot openings can fall out of these devices. Similarly, U.S. Pat. Nos. 5,514,004 and 5,695,356 to Swanson and U.S. Pat. No. 4,504,106 to Fechter each describe an elongated structure having S shaped ends that allow cords to pass in and out along a single line to lock the cords together, which also can be pulled apart with enough force or can disconnect if the cords are much smaller in diameter than the openings in the structure. Also, cords having diameters smaller than the slot openings can fall out of these devices.

U.S. Pat. Des. 401,559 to Angell shows a "retainer for coupled electrical cords" that shows cord ends wrapped around C-shaped ends of a device. However, this device can also easily fail since the C-shaped ends have thin tip portions that can easily break off over time from enough pulling tension resulting in the cords separating from one another. Also, the cords are tied together in a straight line by a device having openings to the same side, which is also not desirable for similar reasons to the other straight line attachments devices previously described. Also, cords having diameters smaller than the slot openings can fall out of these devices.

Various patents have included snapable dual prong type components for holding cords together. See for example, U.S. Pat. No. 2,461,427 to Kneebone; U.S. Pat. No. 4,183,603 to Donarummo; U.S. Pat. No. 4,221,449 to Shugart, Jr.; Des. 269,065 to Hough, Jr.; U.S. Pat. No. 4,832,618 to Gunderson; U.S. Pat. No. 5,336,106 to Osten; and U.S. Pat. No. 5,593,312 to McCracken.

However, these devices require bending and/or snapping various components such as prongs about the cords that can become broken and/or worn overtime thus causing the devices to not being reusable. Also, these devices still require the user have both cords arranged in a single straight line, that similar to the above devices can become disconnected when being pulled apart and/or if the cord diameter is much smaller than the prong holder diameter being used. Additionally, these fixed size devices do not work on all sizes of cords since cords and/or the plugs can come in a variety of sizes. Thus, some cords and/or plugs may be too large or too small to be supported by these devices.

Still furthermore other components have included using plural moveable locking components to hold the cords together. See for example, U.S. Pat. Des. 372,420 to Mendez and U.S. Pat. No. 6,319,044 to Stekelenburg. However these devices require additional assembly by having to combine plural components together which adds extra manufacturing costs and expense to the consumer. Additionally, having plural components raises the possibility that these devices cannot work when any of the components such as the rotating clip in Mendez or the clamping body in Stekelenburg becomes separated and/or lost and/or broken over time. Also, the shapes of these devices are not suitable to be placed and/or moved smoothly around corners and/or steps.

U.S. Pat. No. 5,582,524 to Sanner et al. describes a "cord lock", title that passes a loop portion of each cord into a separate slot and hook. However, this device can easily fail when one of the hook members and/or eyelets breaks off which can occur when enough pulling tension occurs to the cords. Additionally, this device takes up additional space by requiring the interconnected plug and socket to be located to the side of the device. Additionally, the unprotected plug and socket can become separated if the unprotected loop between the interconnected cord and plug, and the device becomes caught on a fixed member such as a table or chair leg and pulling tension is applied to one of the cords. Also, the shape of this device is not suitable to be placed and/or moved smoothly around corners and/or steps.

None of these patents overcomes all the problems with the prior art described above. Thus, the need exists for solutions to the above problems with the prior art.

SUMMARY OF THE INVENTION

A primary objective of the present invention is to provide an improved cord locking device and method of using the device that is easy and simple to use, and inexpensive to manufacture.

A secondary objective of the present invention is to provide an improved cord locking device and method of using the device that is compact and does not require separate components such as springs and snaps that can easily break off, and/or are expensive to manufacture.

A third objective of the present invention is to provide an improved cord locking device and method of using the device that is aesthetically pleasing and fully protects the interconnected cords without leaving the cords dangling from the device.

A fourth objective of the present invention is to provide an improved cord locking device and method of use that does not become disconnected by being pulled apart and/or by using smaller diameter cords in large openings.

A fifth objective of the present invention is to provide an improved cord locking device and method of using the device that unlike prior devices requires separately wrapping ends of both cords separately about side oriented slots and/or coiled ends of the device.

A sixth objective of the present invention is to provide an improved cord locking device and method of using the device that does not require plural components in the device and/or requires any of the components to must move respective to another component to lock the cords to one another.

A seventh objective of the present invention is to provide an improved cord locking device and method of using the device that allows for one cord to be connected to one, two, three or more additional cords, at a time.

An eighth objective of the present invention is to provide an improved cord locking device and method of using the device that allows cords to be wrapped up to an over approximately 360 degrees(for example, approximately 450 degrees) or more about a locking device, to adequately secure the cord(s) to the locking device.

A locking device for keeping interconnected electrical cords from separating from one another, can include a planar elongated device, with a first set of staggered arranged side edge facing slots on one end of the device for allowing one end of one of the interconnected cords to be wrapped about, and with a second set of staggered side edge facing slots on an opposite end of the device for allowing one end of another of the interconnected cords to be wrapped about, wherein pulling the interconnected cords apart causes the wrapped cords to lock into the device preventing the interconnected cords from disconnecting from one another. Unlike, the prior art, the novel locking devices allow for cord(s) to be wrapped up to an over approximately 360 degrees(for example, approximately 450 degrees) or more about a locking device, to adequately secure the cord(s) to the locking device.

The interconnected cords can include a first electrical cord having a male plug, and a second electrical cord having a female socket for receiving the male plug.

The first set of staggered arranged side edge facing slots, and the second set of staggered arranged side edge facing slots, can each include three slots, wherein two of the slots are to one side, with one slot on an opposite side located between the two slots.

The slots can be curved shaped side edge facing slots, and can have a C-shape with an opening facing to side edges of the device. The slots can be rectangular shaped side edge facing slots. The slots can also be diamond shaped side edge facing slots. And the slots can also be hook shaped side edge facing slots. Other shapes of the slots can also be used for locking wrapped cords to the devices.

The invention can be used with all types and sizes of cords, such as but not limited to flat cords, oval cords, special coated cords(i.e. Teflon coated), and the like.

The devices can also be used with multi-cord electrical cord adapters for interconnecting with more than one electrical cord.

Other versions of the devices can include an upper single extending end, opposite plural extending lower ends parallel to one another, the latter forming a fork type shape.

Another version can include an upper single extending end, opposite plural extending lower ends that expand apart from one another in a fan shape.

Another device version can be a cross-configuration for allowing electrical cords to be interconnected to one another in perpendicular arrangement to one another.

Other versions can include spring/coil ends which allow for electrical cords to wrap about links in the coils/springs.

Novel, methods of wrapping, and pulling the cords for locking the interconnected cords together is also described.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

Figure 1:
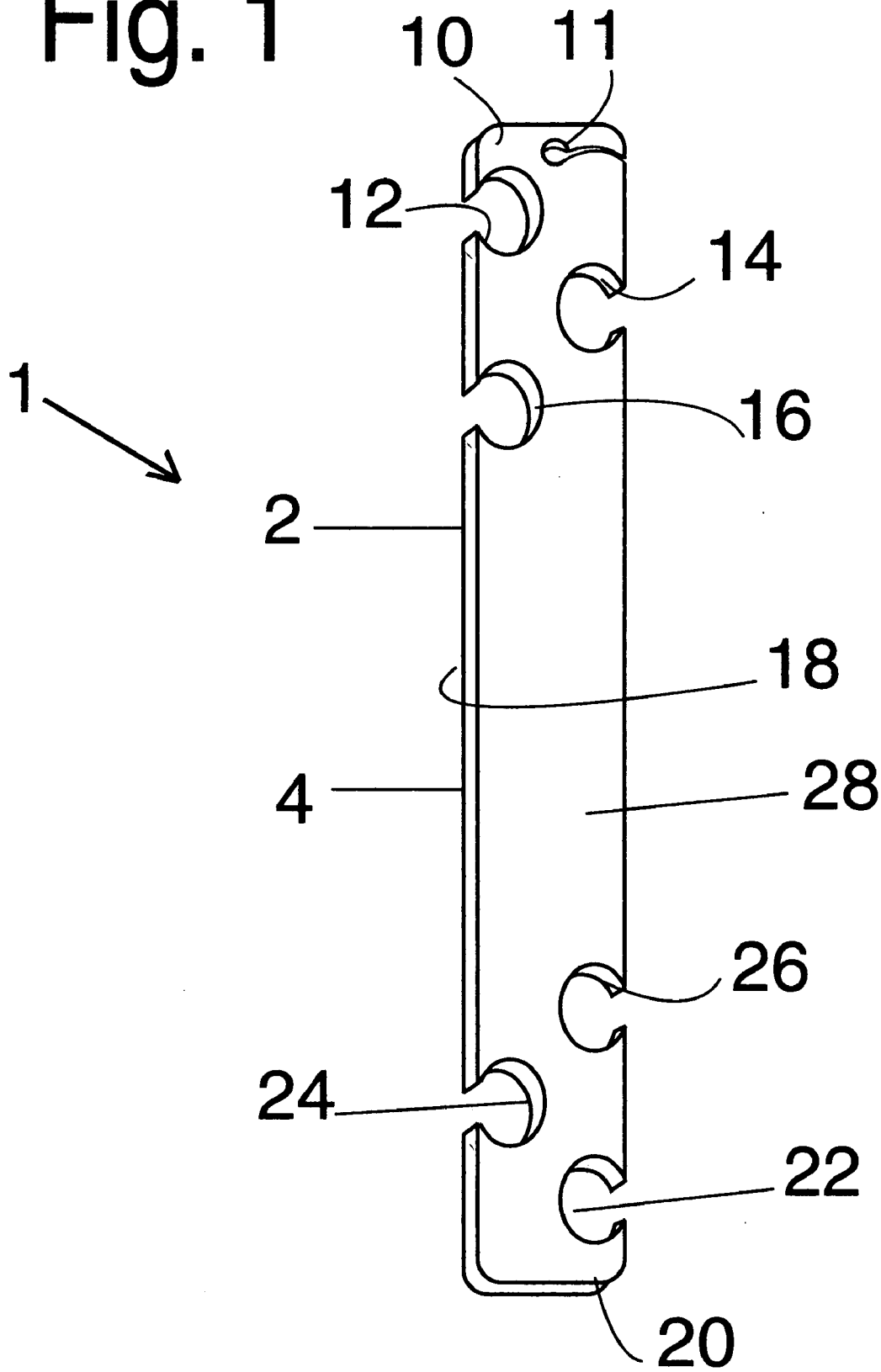
FIG. 1 is a perspective view of a first preferred embodiment of an elongated planar locking device with alternating staggered side facing curved edge slots.

FIG. 1 is a perspective view of a first preferred embodiment of an elongated planar locking device 1 with alternating side edge facing curved slots 12, 14, 16 on one end 10, and alternating side edge facing curved slots 22, 24, 26 on an opposite end 20. The device 1 can have similar dimensions to a small ruler being approximately 8 to approximately 16 inches in length and approximately 1/10 to approximately ½ inch in thickness. Device 1 can include a small hanging slot portion 11 at one end when the device is hung from a hook in a retail store, and/or for allowing the user to hang the device from a fastener such as a nail, a hook, a wire, a fence section, and the like, when not being used. The hanging slot portion can be used to elevate the device off the ground when it is not being used. The corners of the device can be rounded so as to reduce hang-ups and allow the device 1 to be smoothly moved around other objects.

Figure 2:
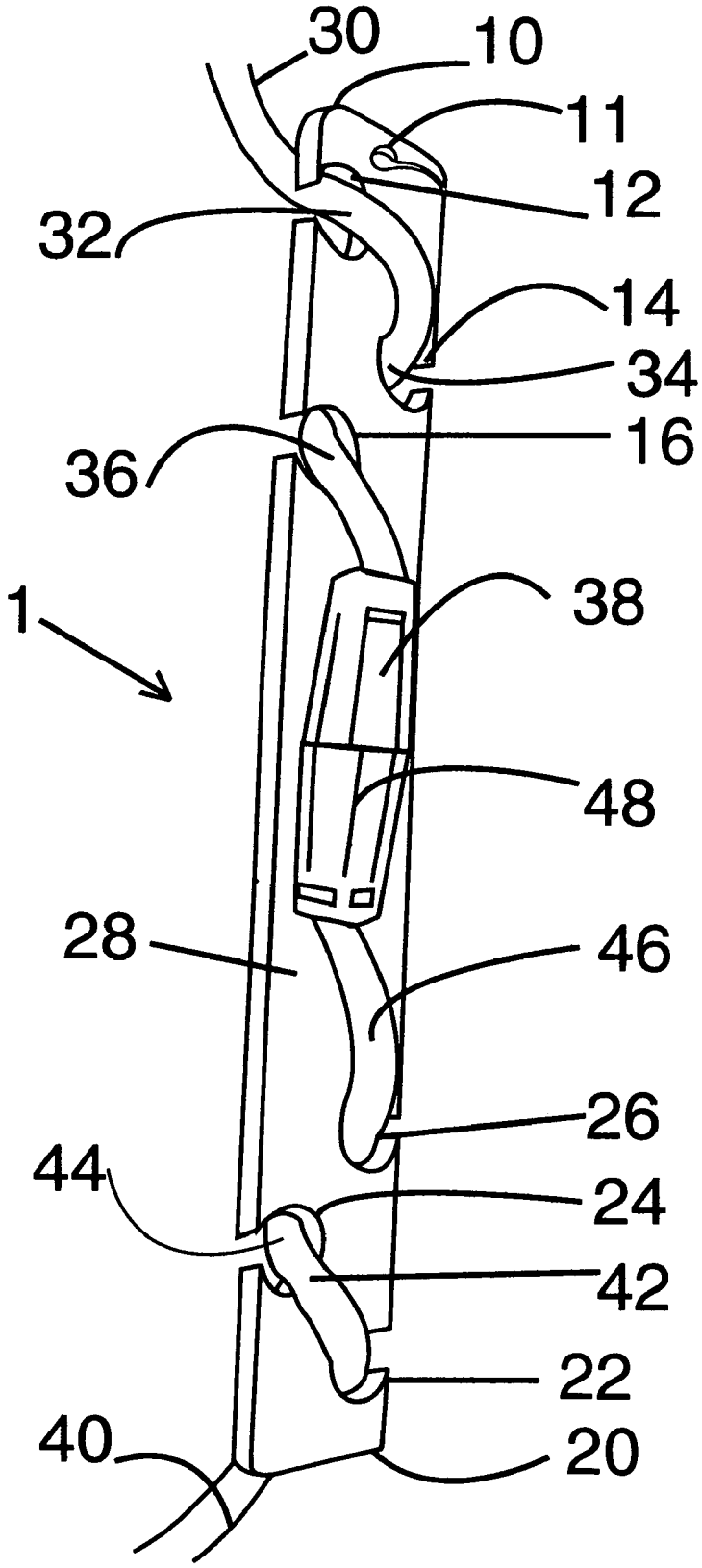
FIG. 2 shows the device of FIG. 1 locking two interconnected cords together.

FIG. 2 shows the device 1' of FIG. 1 locking two interconnected cords 30, 40 thereon. A first cord 30 can have a cord portion 32 passing through curved slot 32 from a front side 28 to a rear side 18 of the planar device 1, followed by a second cord portion 34 passing through an opposite staggered positioned side edge curved slot 34 along device 1 to pass the cord from the front side 28 back to the rear side 18, followed by passing a third cord portion 36 of the cord 30 through another staggered positioned opposite sided curved slot 36 from rear side 18 to front side 28 of the device 1 ending in cord end 38 being either a male plug end or a female receiving end. As shown, first cord 30 can be wrapped around and into side edges of end 10 of the device 1. Unlike, the prior art, the novel locking devices allow for cord(s) to be wrapped up to an over approximately 360 degrees(for example, approximately 450 degrees) or more about a locking device, to adequately secure the cord(s) to the locking device.

A second cord 40 can have its exposed end 48 that is either a female receiving end or a male plug end that is mateably interconnected with cord end 38 across a mid portion of the front face side 28 of the device 1. Second cord 40 can have a cord portion 46 that passes through curved slot 26 from front side 28 to rear side 18, and a second cord portion 44 which passes through opposite side curved slot 24 spaced further along device end 20 from rear side 18 to front side 28, followed by a third cord portion 42 passing from a front side 28 to the rear side 18 of the device 1. As shown, second cord 40 can be wrapped around and into side edges of end 20 of the device 1, so that the device side edges offers protection to the wrapped cords 30, 40.

As shown in FIG. 2, remaining ends of the respective cords 30, 40 are both located on the rear side 18 of the device 1, while the interconnected ends 38, 48 are on the front side of the device 1. Unlike the prior art, here, pulling the cords 30, 40 apart further locks the cords 30, 40 together within the respective slots in the device 1.

The curved slots in FIGS. 1–2 can have C-shaped side facing slots shapes with tip ends having a small opening. Additionally, the curved slots can have a larger opening. The staggered arrangement of the slots on each end 10, 20 of the device 1, can form the appearance of a triangular configuration, if each set of slots are connected to one another. The C-shaped slots can have a diameter of approximately 0.75 inches, and the end openings can form edges having a diameter that is slightly smaller than the diameter of the cord, so that the open edges of the slots clip about the cords, and prevent the cords from easily falling out of the slots.

While three slots are shown on each end, the invention can have as little as two staggered slots on each end, or four or more staggered slots on each end.

The device 1 can have indicia 2 along a side edge such as ruler markings(i.e. standard and/or metric) to allow the device to be used as a measuring tool. The edge 4 of the device 1 can also be used as a straight edge so that the device 1, can be used to mark straight lines on surfaces such as walls, floors, ceilings, that are going to be worked on, and/or on materials such as wood, and the like, that are going to be cut, and the like.

Figure 3:
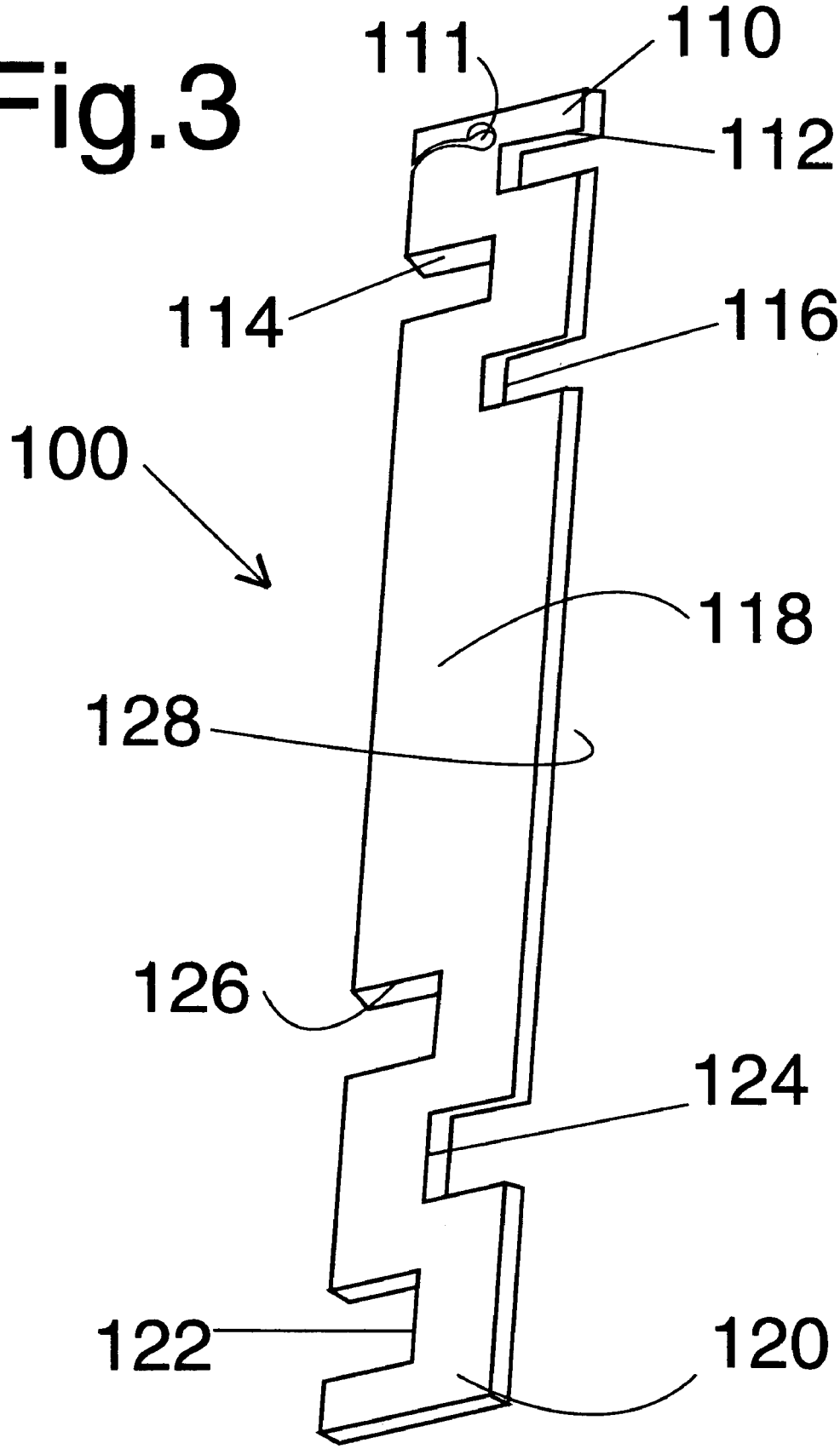
FIG. 3 is a perspective view of a second preferred embodiment of an elongated locking device with alternating staggered side facing rectangular edged slots.
Figure 4:
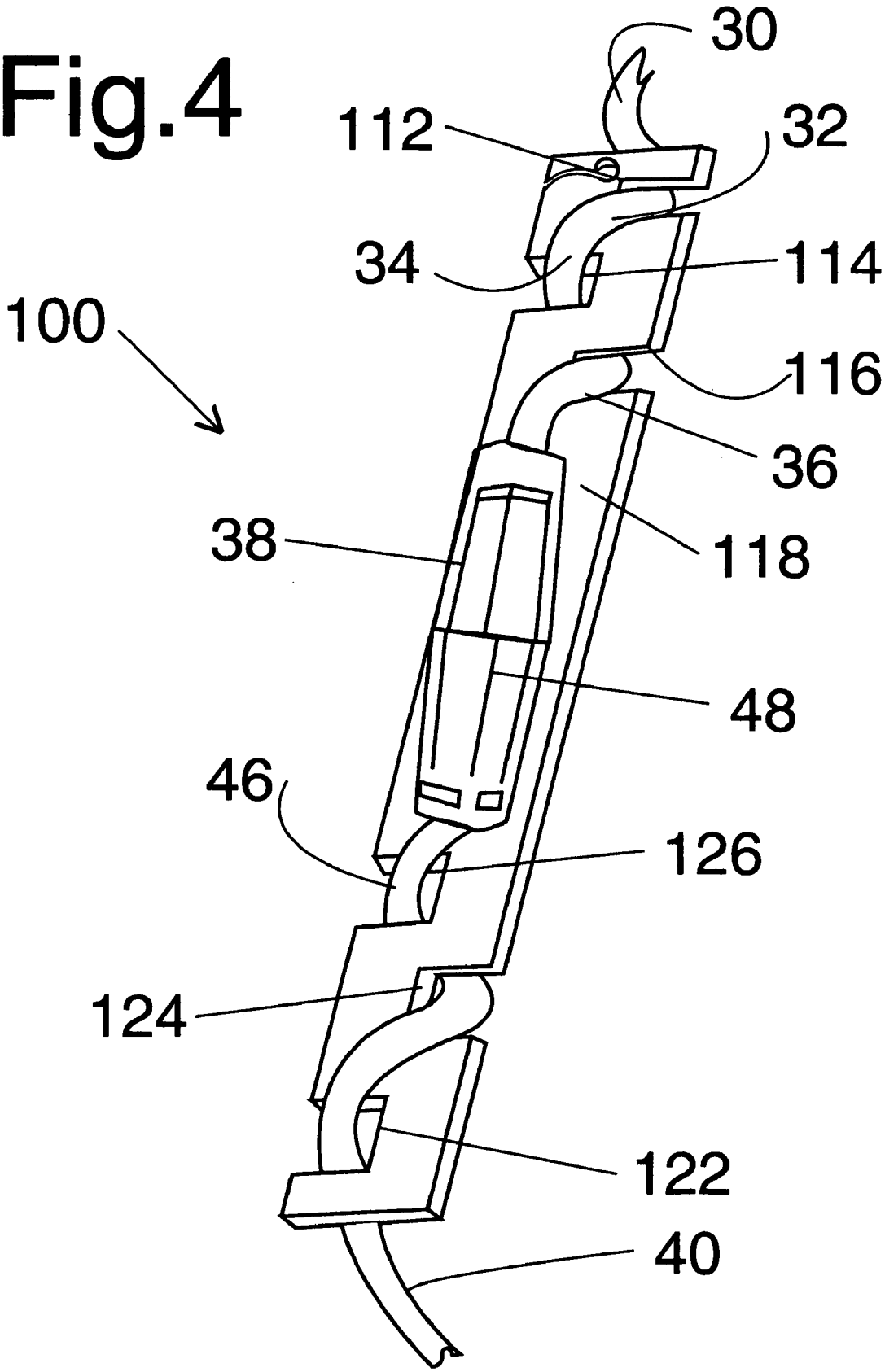
FIG. 4 shows the device of FIG. 3 locking two interconnected cords together.

FIG. 3 is a perspective view of a second preferred embodiment of an elongated locking device 100 with alternating staggered side facing rectangular edged slots. FIG. 4 shows the device 100' of FIG. 3 locking two interconnected cords 30, 40 together. The second device 100 can include ends 110, 120 each with respective staggered slots 112, 114, 116, and 122, 124, 126, respectively, and hanging slot 111 that are similarly located to the slots of the preceding embodiment with the exception that the slots here are rectangular cut-out side facing shapes. The second device 100, 100' can lock the cords 30, 40 together similarly by wrapping respective cord portions 32, 34, 36 into side facing slots 112, 114, 116, and cord portions 42, 44, 46 into side facing slots 122, 124, 126 similarly to that of the preceding embodiment. This device can also function and lock similarly to that of the preceding embodiment.

Figure 5:
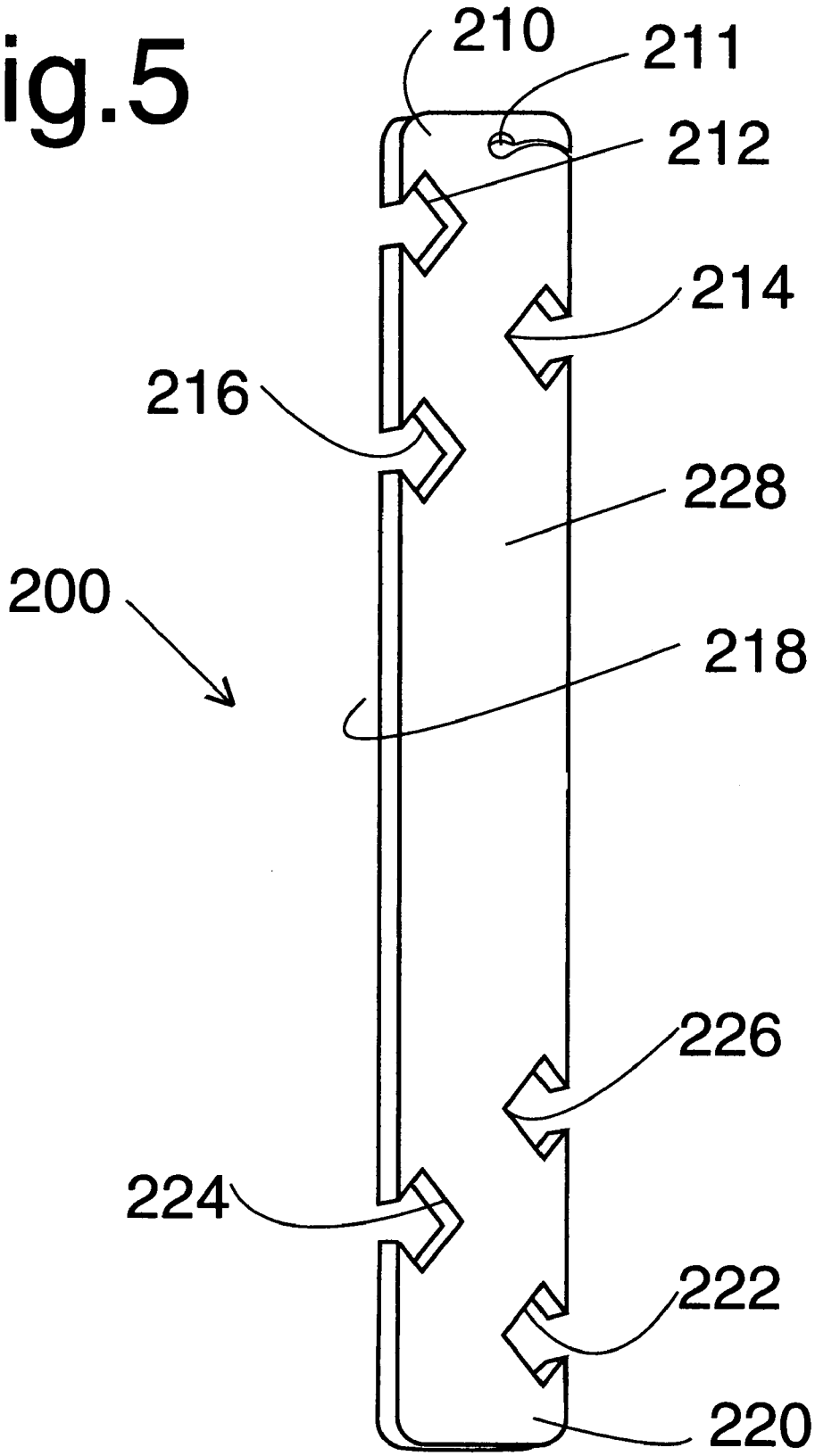
FIG. 5 is a perspective view of a third preferred embodiment of an elongated locking device with alternating staggered side facing diamond shaped edged slots.
Figure 6:
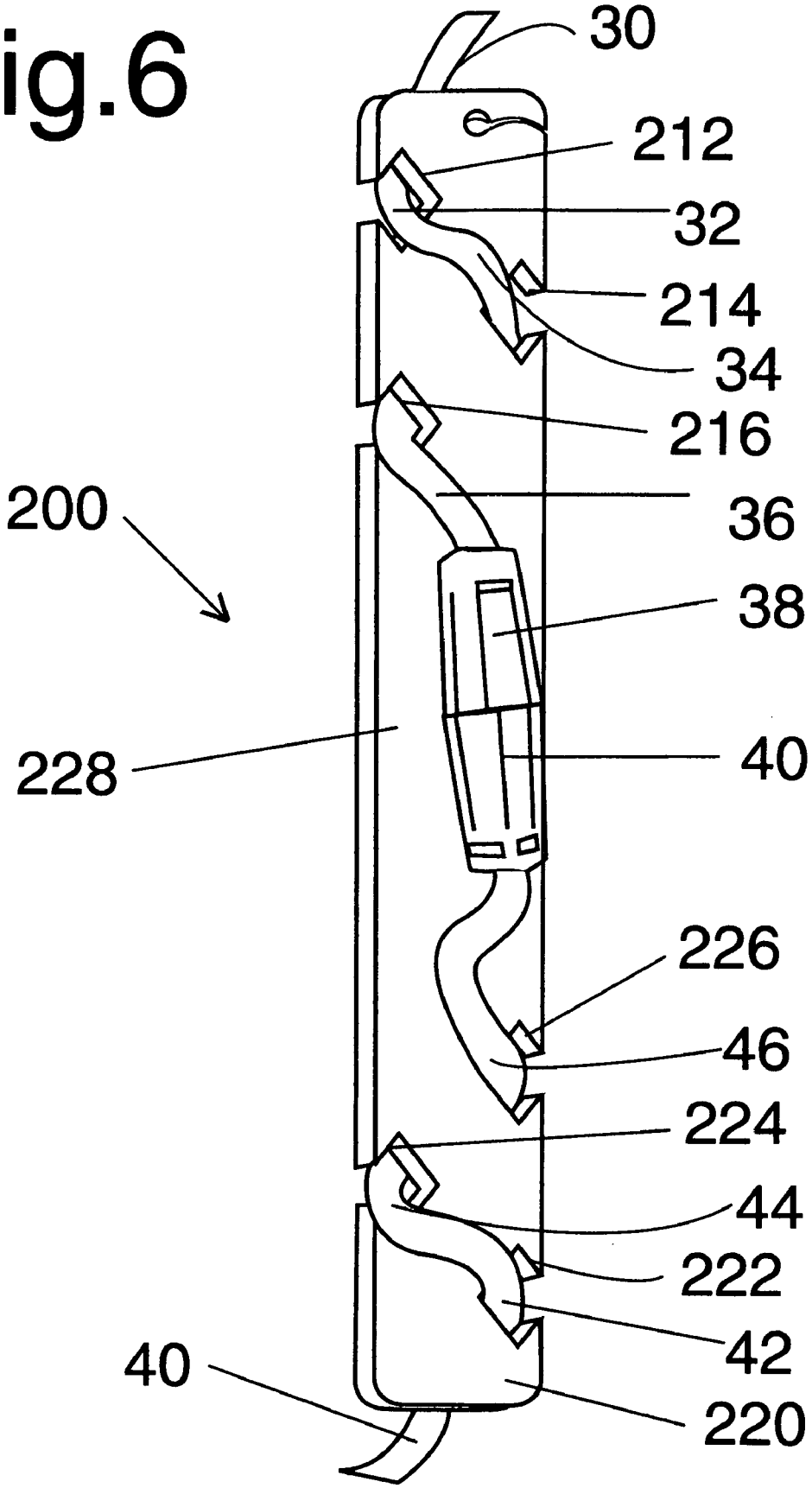
FIG. 6 shows the device of FIG. 5 locking two interconnected cords together.

FIG. 5 is a perspective view of a third preferred embodiment of an elongated locking device 200 with alternating staggered side facing diamond shaped edged slots. FIG. 6 shows the device 200' of FIG. 5 locking two interconnected cords 30, 40 together. The third device 200 can include ends 210, 220 each with respective staggered slots 212, 214, 216, and 222, 224, 226, respectively, and hanging slot 211 that are similarly located to the slots of the preceding embodiment with the exception that the slots here are diamond shaped side facing shapes. The third device 200, 200' can lock the cords 30, 40 together similarly by wrapping respective cord portions 32, 34, 36 into side facing slots 212, 214, 216, and cord portions 42, 44, 46 into side facing slots 222, 224, 226 similarly to that of the preceding embodiments. This device can also function and lock similarly to that of the preceding embodiments.

Figure 7:
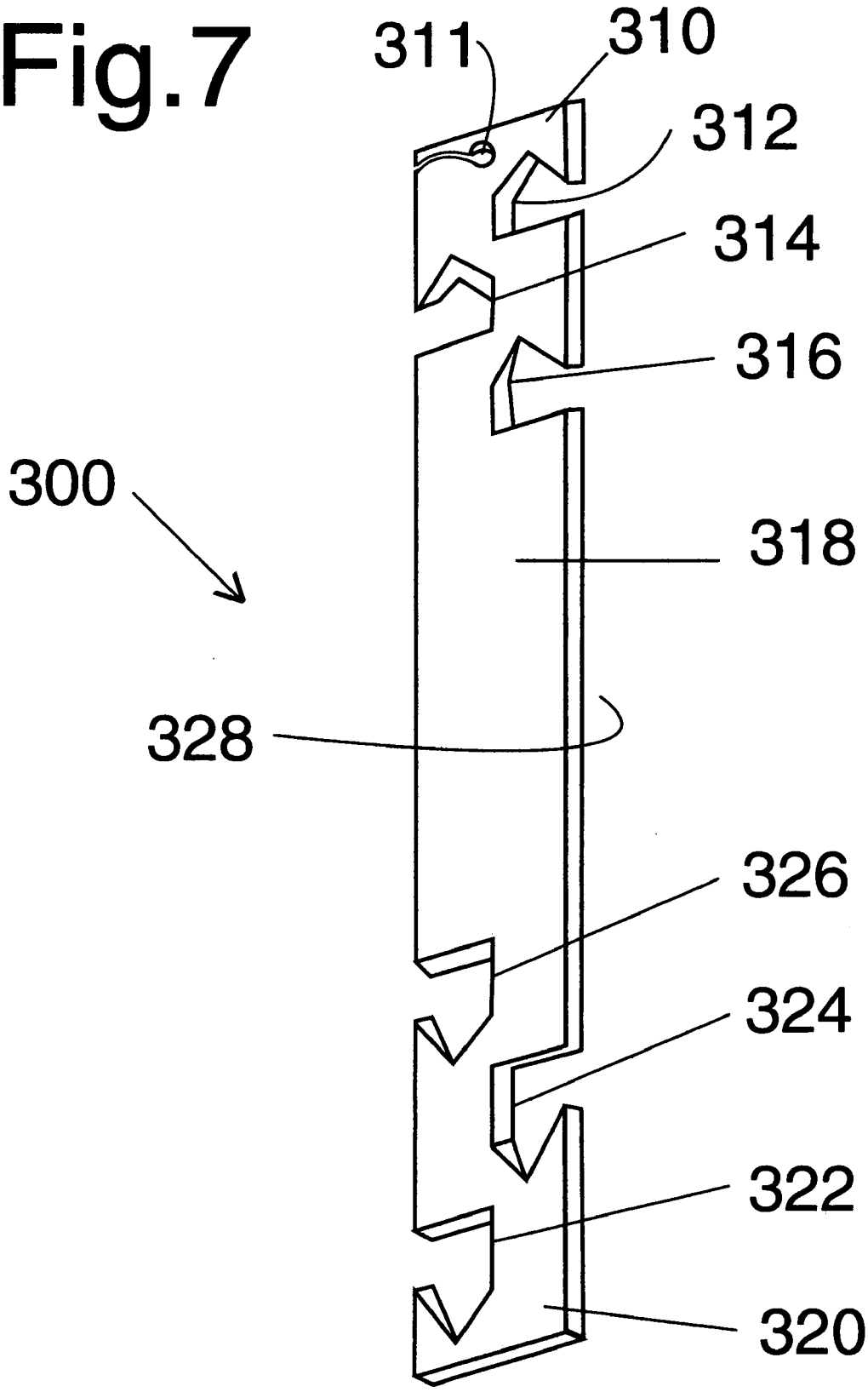
FIG. 7 is a perspective view of a fourth preferred embodiment of a locking device with alternating staggered side facing rectangle with triangle hook shaped edged slots.
Figure 8:
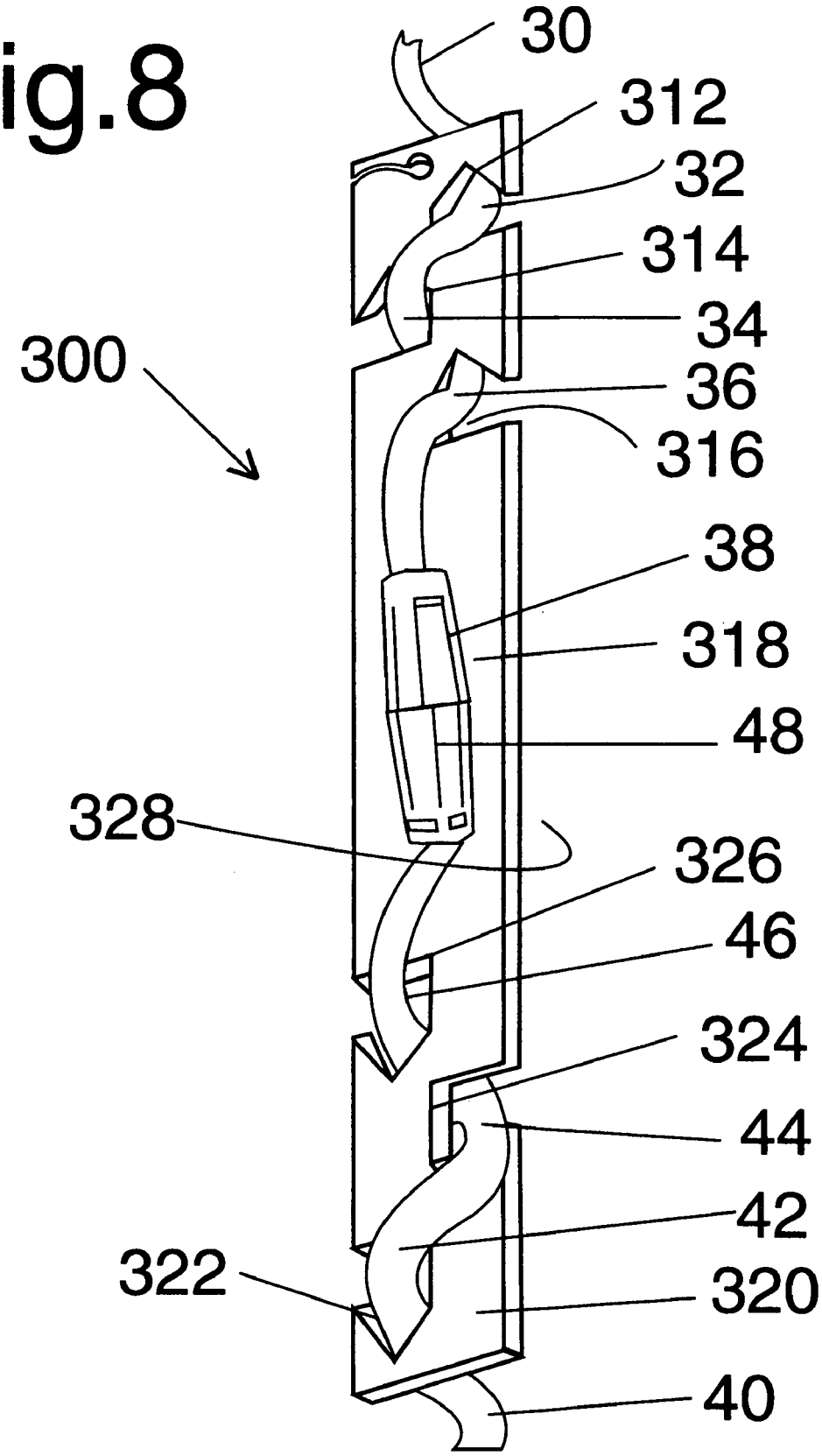
FIG. 8 shows the device of FIG. 7 locking two interconnected cords together.

FIG. 7 is a perspective view of a fourth preferred embodiment of a locking device 300 with alternating staggered side facing rectangle with triangle hook shaped edged slots. FIG. 8 shows the device of FIG. 7 locking two interconnected cords 30, 40 together. The fourth device 300 can include ends 310, 320 each with respective staggered slots 312, 314, 316, and 322, 324, 326, respectively, and hanging slot 311 that are similarly located to the slots of the preceding embodiment with the exception that the slots here are rectangular with triangular hook shaped side facing shapes. The fourth device 300, 300' can lock the cords 30, 40 together similarly by wrapping respective cord portions 32, 34, 36 into side facing slots 312, 314, 316, and cord portions 42, 44, 46 into side facing slots 322, 324, 326 similarly to that of the preceding embodiments. This device can also function and lock similarly to that of the preceding embodiments. The hook portions of the slots can further lock the respective cords 30, 40 to the device 300.

Figure 9:
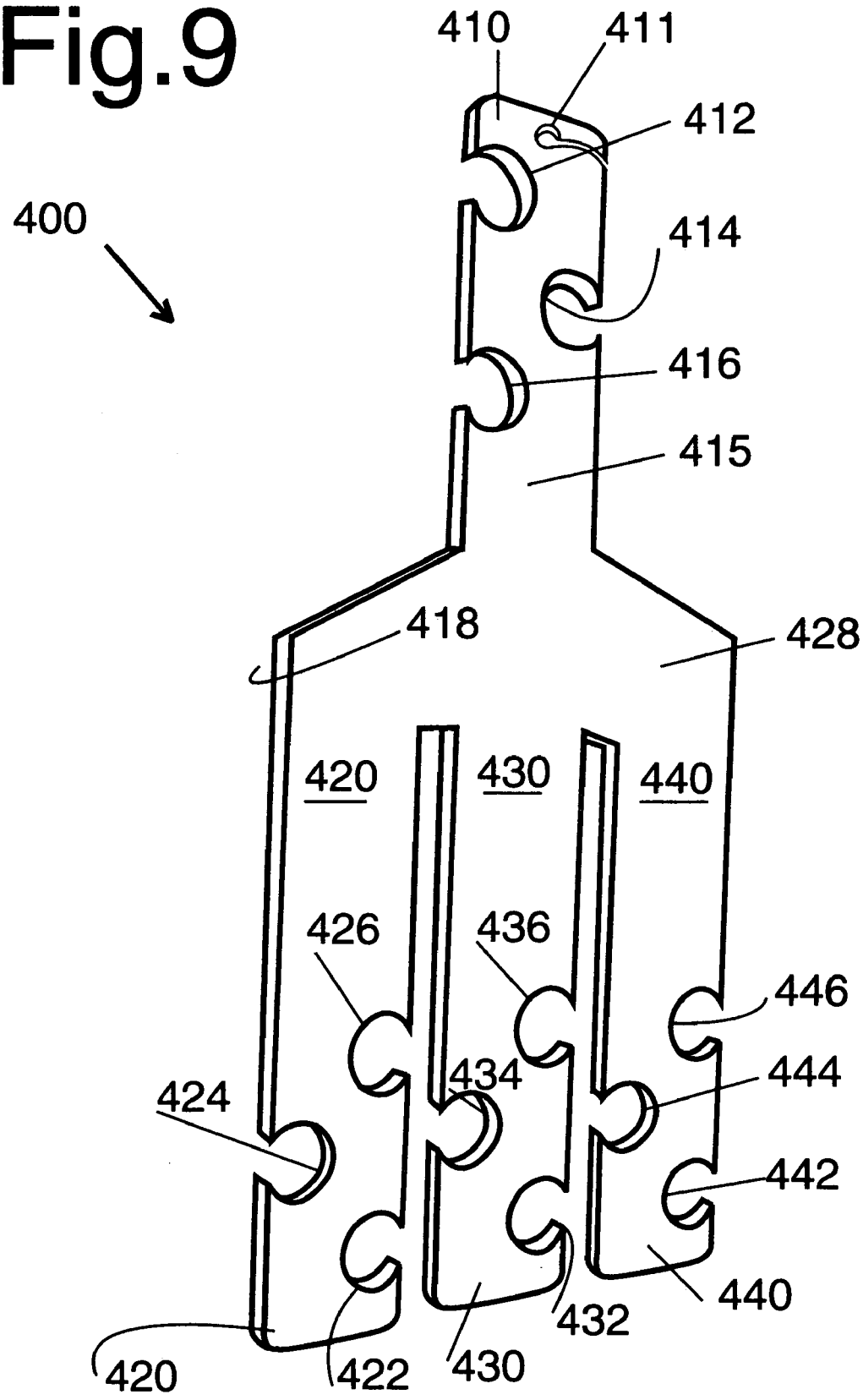
FIG. 9 is a perspective view of a fifth preferred embodiment of a locking device with parallel ends opposite a single end for locking plural plugs to a single extension cord.
Figure 10:
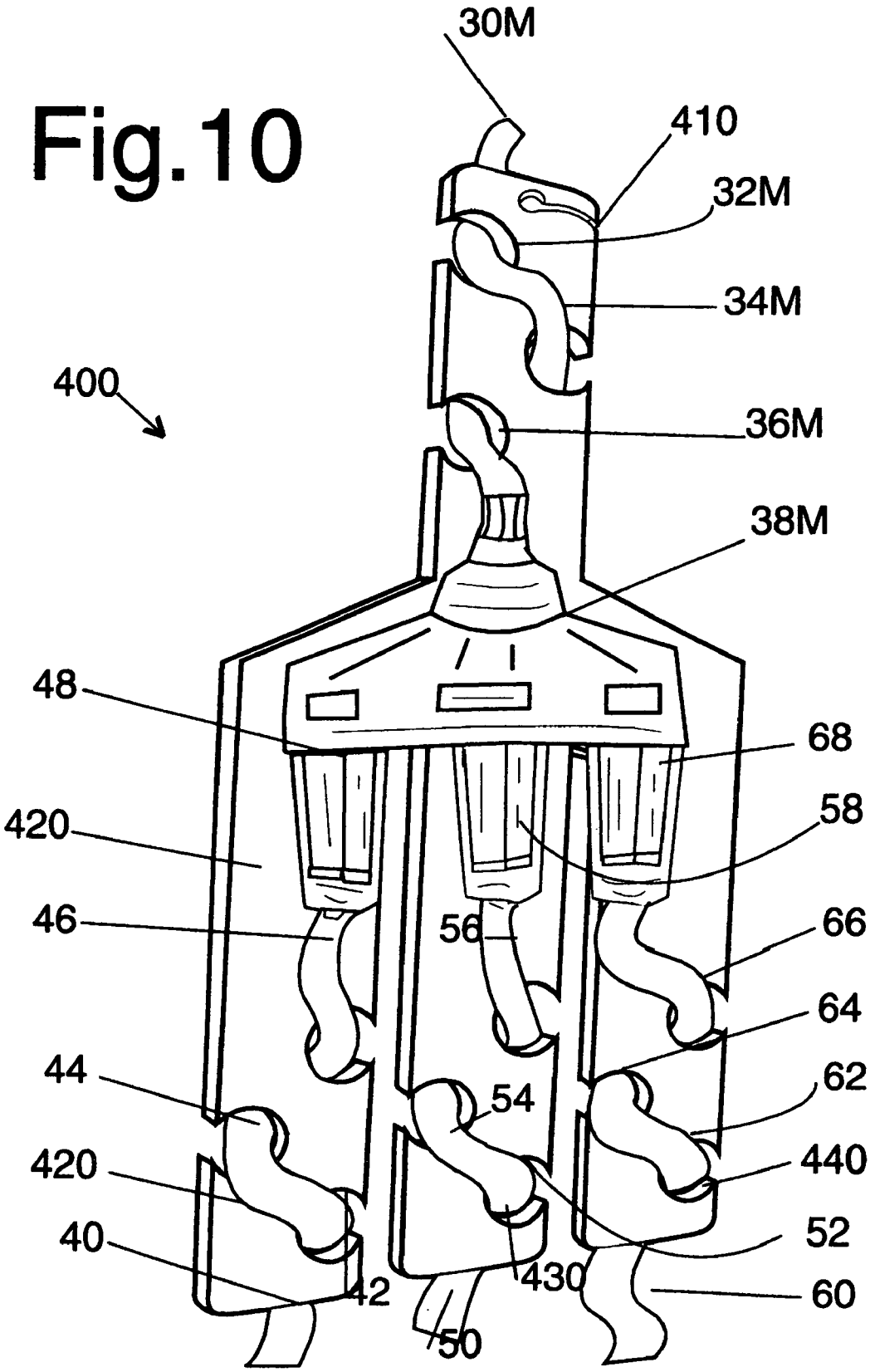
FIG. 10 shows the device of FIG. 9 locking plural interconnected cords together.

FIG. 9 is a perspective view of a fifth preferred embodiment of a locking device 400 for locking plural plugs of separate extension cords to a multi end extension cord 38M. FIG. 10 shows the device 400' of FIG. 9 locking plural interconnected cords together.

The fifth device 400 can include an upper end 410 having staggered slots 412, 414, 416 and a hanging slot 411 similarly located to upper ends 10, 110, 210, 310 with respective slots previously described. The difference here is instead of one opposite end, there can be plural ends 420, 430, 440, that together with upper end 410 can form a fork type shape.

Opposite parallel arranged ends 420, 430, 440 can each have staggered arranged slots 422, 424, 426 and 432, 434, 436, and 442, 444, 446 for allowing respective cord portions 42, 44, 46 and 52, 54, 56, and 62, 64, 66 of respective cords 40, 50, and 60 to be wrapped therein similar those in the previous embodiments. Prong type ends 48, 58 and 68 of the cords, 40, 50, 60 can be mateably interconnected into an elongated female receiving slot(s) 38M of a multi-electrical extension cord adapter 30M. The multi-electrical extension cord adapter 30M can have cord portions 32M, 34M and 36M wrapped into slots 412, 414, 416 of end 410 similar to the previous embodiments. This device can also function and lock similarly to that of the preceding embodiments, and the slots can also have different shapes as those shown in the previous embodiments.

Figure 11:
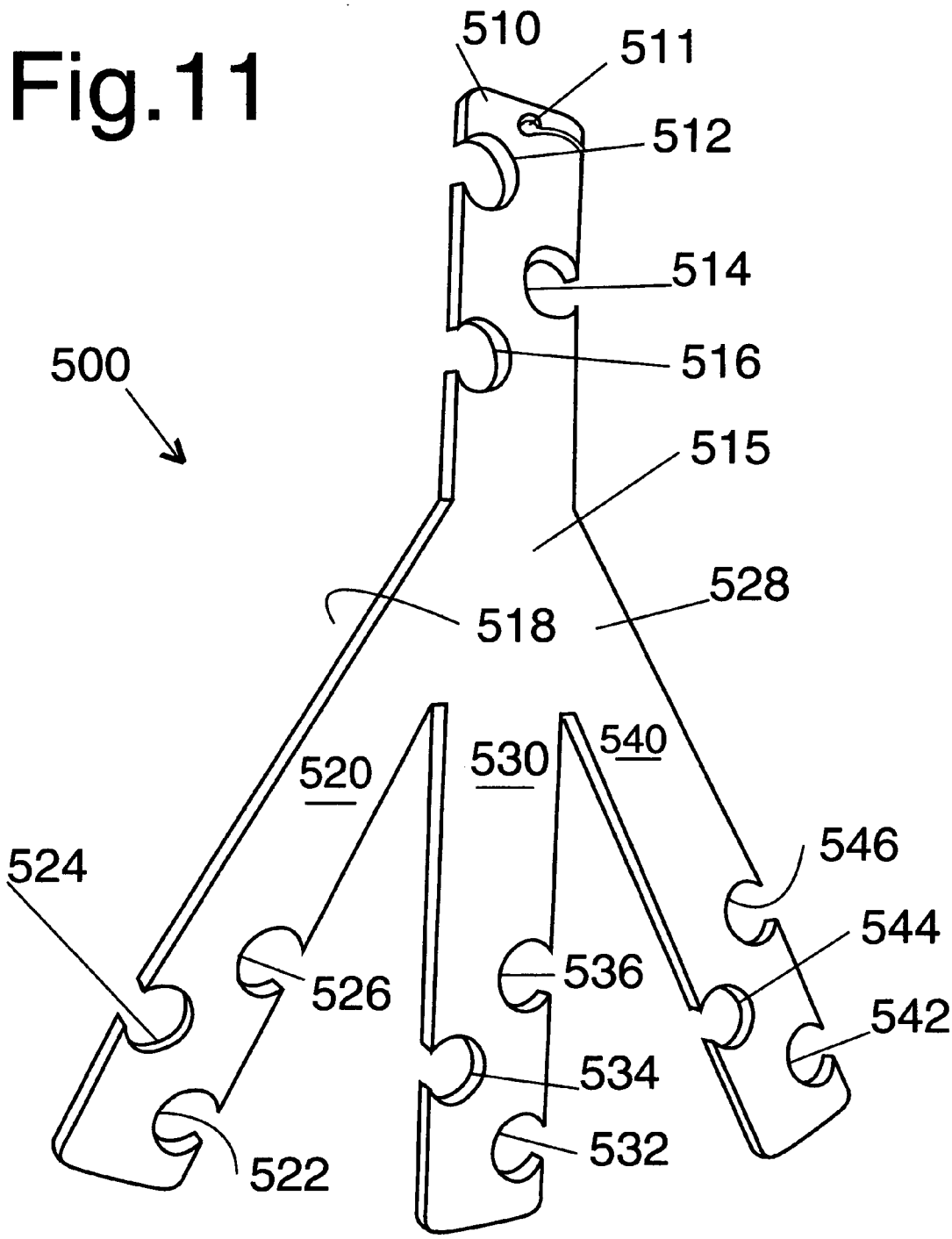
FIG. 11 is a perspective view of a sixth preferred embodiment of a locking device with expanding ends opposite a single end for locking plural plugs to a single extension cord.
Figure 12:
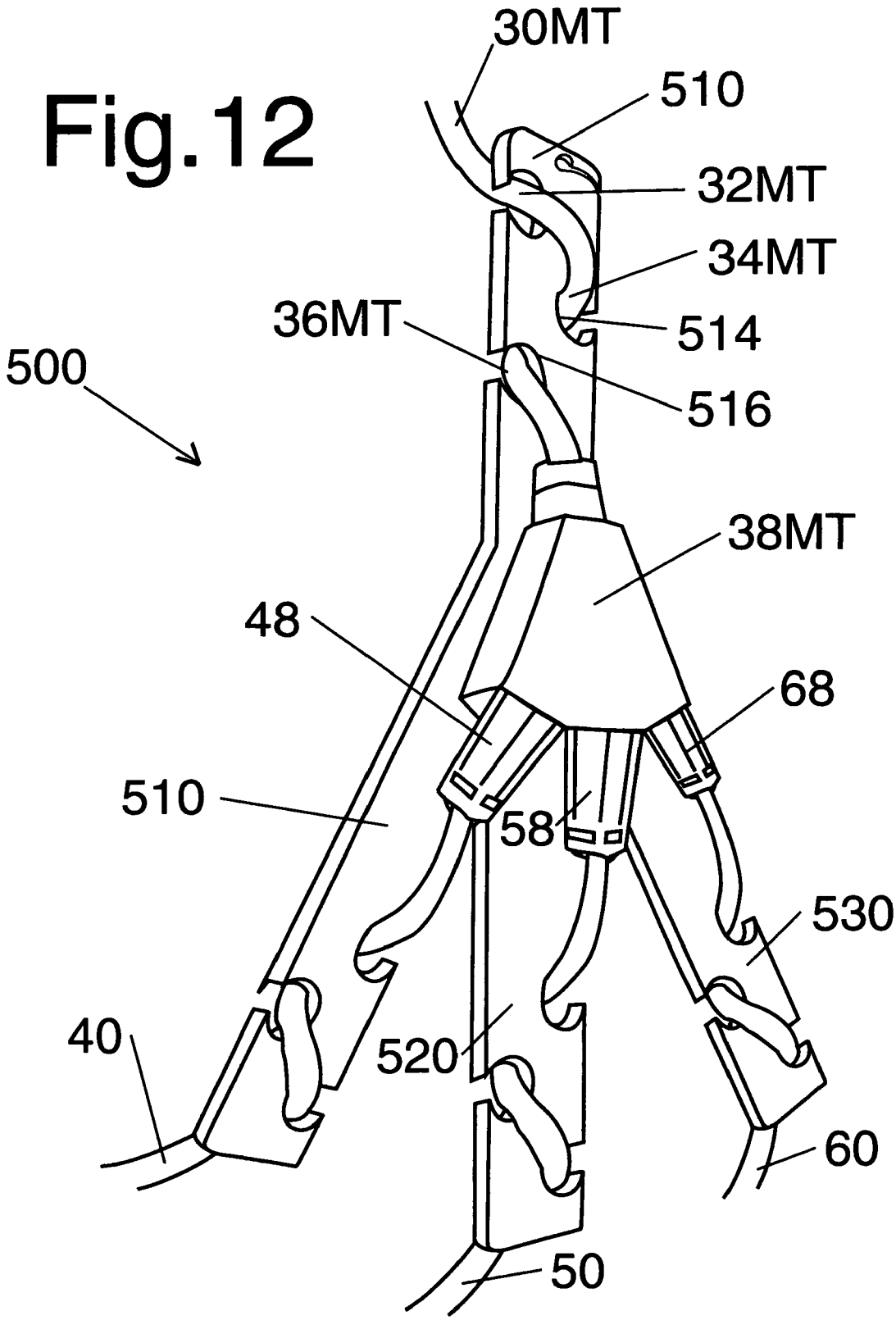
FIG. 12 shows the device of FIG. 11 locking plural interconnected cords together.

FIG. 11 is a perspective view of a sixth preferred embodiment of a locking device 500 with outwardly expanding ends 510, 520, 530 opposite a single end 510 for locking plural plugs 48, 58, 68 to a single multi-extension cord 38MT. FIG. 12 shows the device 500' of FIG. 11 locking plural interconnected cords 40, 50, 60 attached thereon.

The sixth device 500 can include an upper end 510 having staggered slots 512, 514, 516 and a hanging slot 511 similarly located to upper ends 10, 110, 210, 310, 410 with respective slots previously described. The difference here is instead of one opposite end, there can be plural ends 520, 530, 540, that together with upper end 510 can form a an outwardly expanding fan shape.

Opposite parallel arranged ends 520, 530, 540 can each have staggered arranged slots 522, 524, 526 and 532, 534, 536, and 542, 544, 546 for allowing respective cord portions 42, 44, 46 and 52, 54, 56, and 62, 64, 66 of respective cords 40, 50, and 60 to be wrapped therein similar those in the previous embodiments. Prong type ends 48, 58 and 68 of the cords, 40, 50, 60 can be mateably interconnected into an elongated female receiving slot(s) 38MT of a multi-electrical extension cord adapter 30MT. The multi-electrical extension cord adapter 30MT can have cord portions 32MT, 34MT and 36MT wrapped into slots 512, 514, 516 of end 510 similar to the previous embodiments. This device can also function and lock similarly to that of the preceding embodiments, and the slots can also have different shapes as those shown in the previous embodiments.

Figure 13:
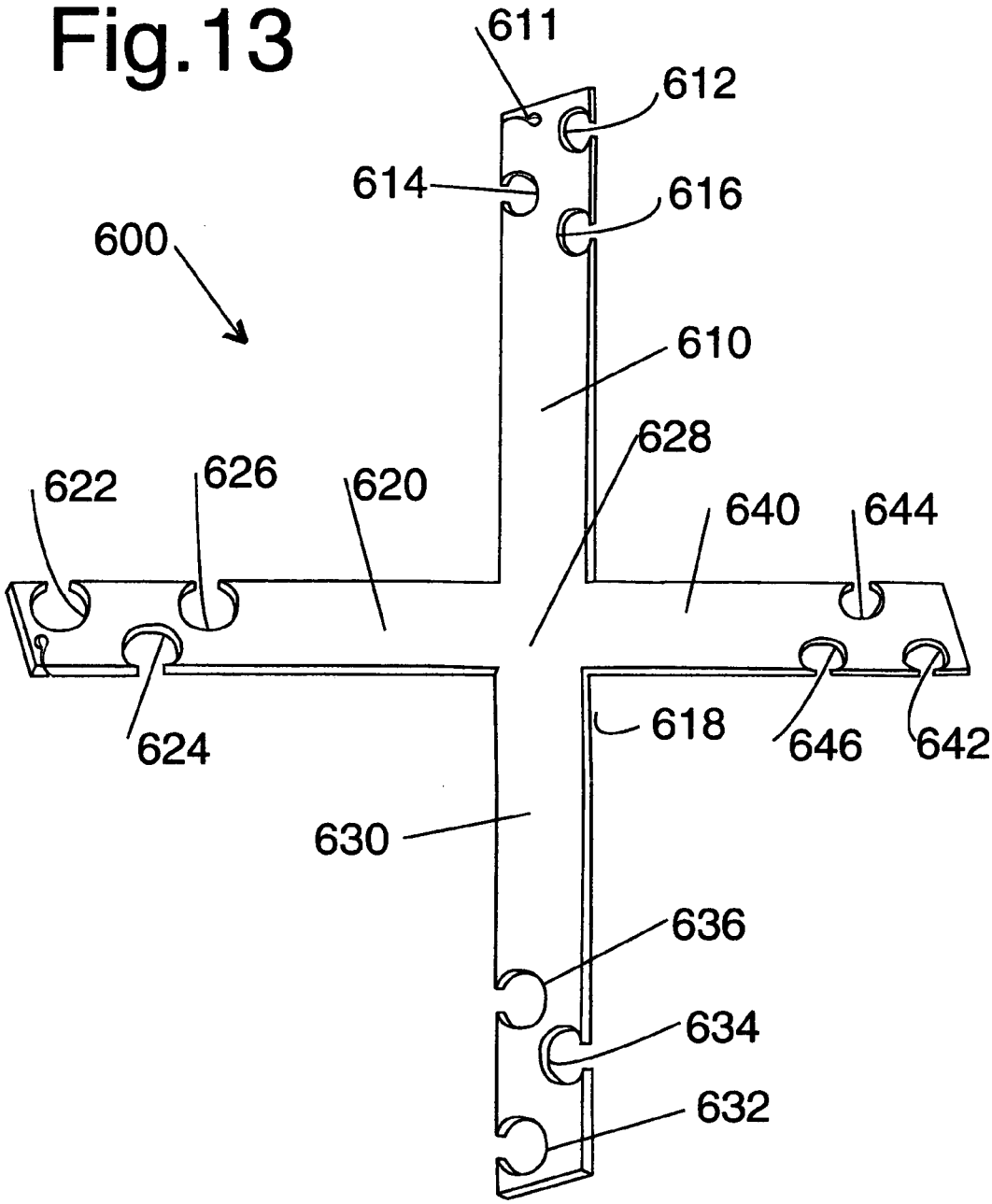
FIG. 13 is a perspective view of a seventh preferred embodiment of a cross shaped locking device for a four way interconnection.
Figure 14:
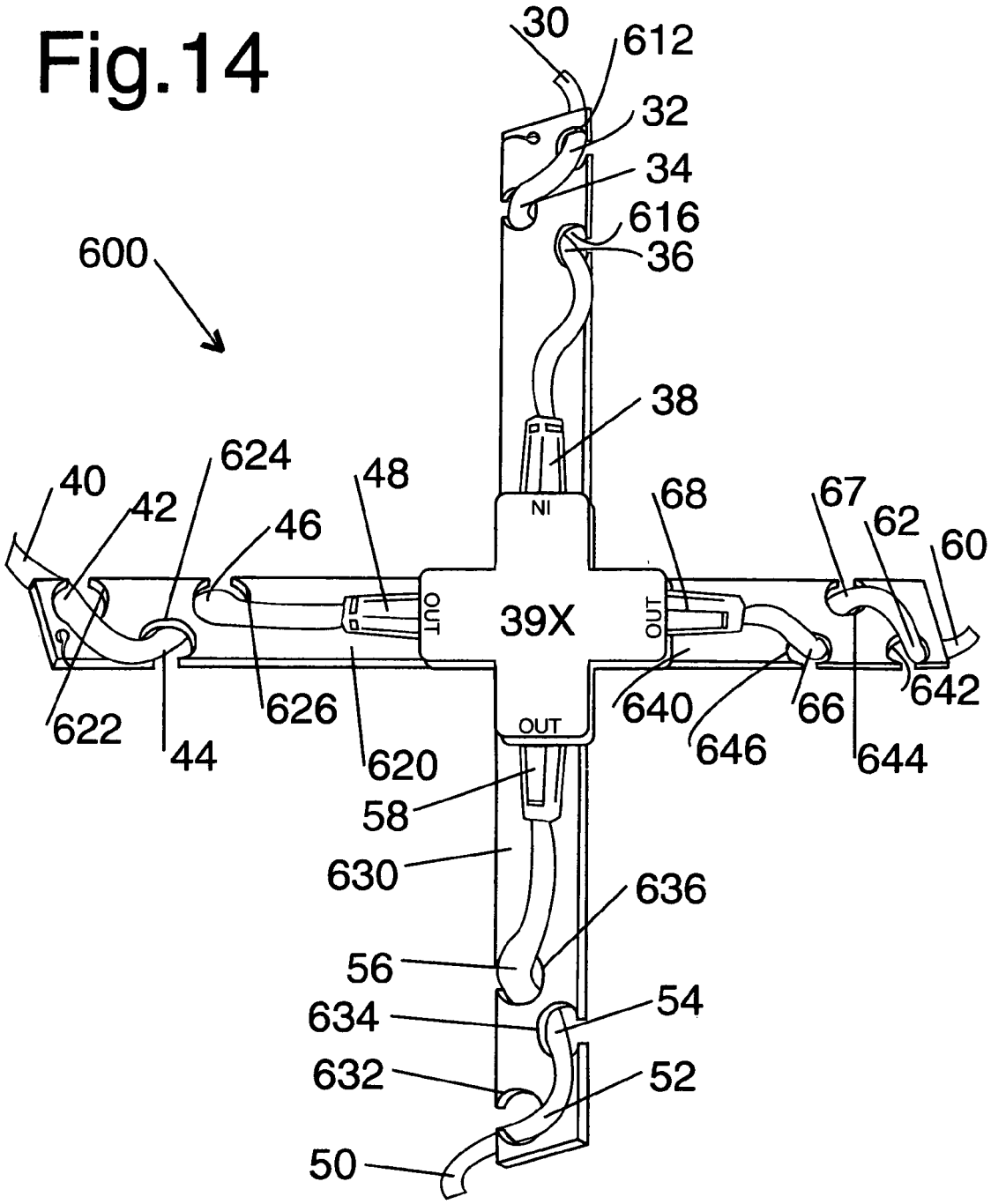
FIG. 14 shows the device of FIG. 13 locking plural interconnected cords together.

FIG. 13 is a perspective view of a seventh preferred embodiment of a cross shaped locking device 600 for a four way interconnection. FIG. 14 shows the device 600' of FIG. 13 locking plural interconnected cords 30, 40, 50, 60 connected together.

The seventh device 600 can include four elongated members 610, 620, 630, 640 arranged in a cross configuration meeting at a mid-region 618, 628 and hanging slot 611 similarly with respective slots previously described. The difference here is the locking device has a cross configuration.

The four elongated members 610, 620, 630, 640 can have respective slots 612, 614, 616, and 622, 624, 626 and 632, 634, 636, and 642, 644, 646 for allowing respective cord portions 32, 34, 36 and 42, 44, 46 and 52, 54, 56, and 62, 64, 66 of respective cords 30, 40, 50, and 60 to be wrapped therein similar those in the previous embodiments. Prong type ends 38, 48, 58 and 68 of the cords, 30, 40, 50, 60 can be mateably interconnected into a four way connector 39X. This device can also function and lock similarly to that of the preceding embodiments, and the slots can also have different shapes as those shown in the previous embodiments.

Figure 15:
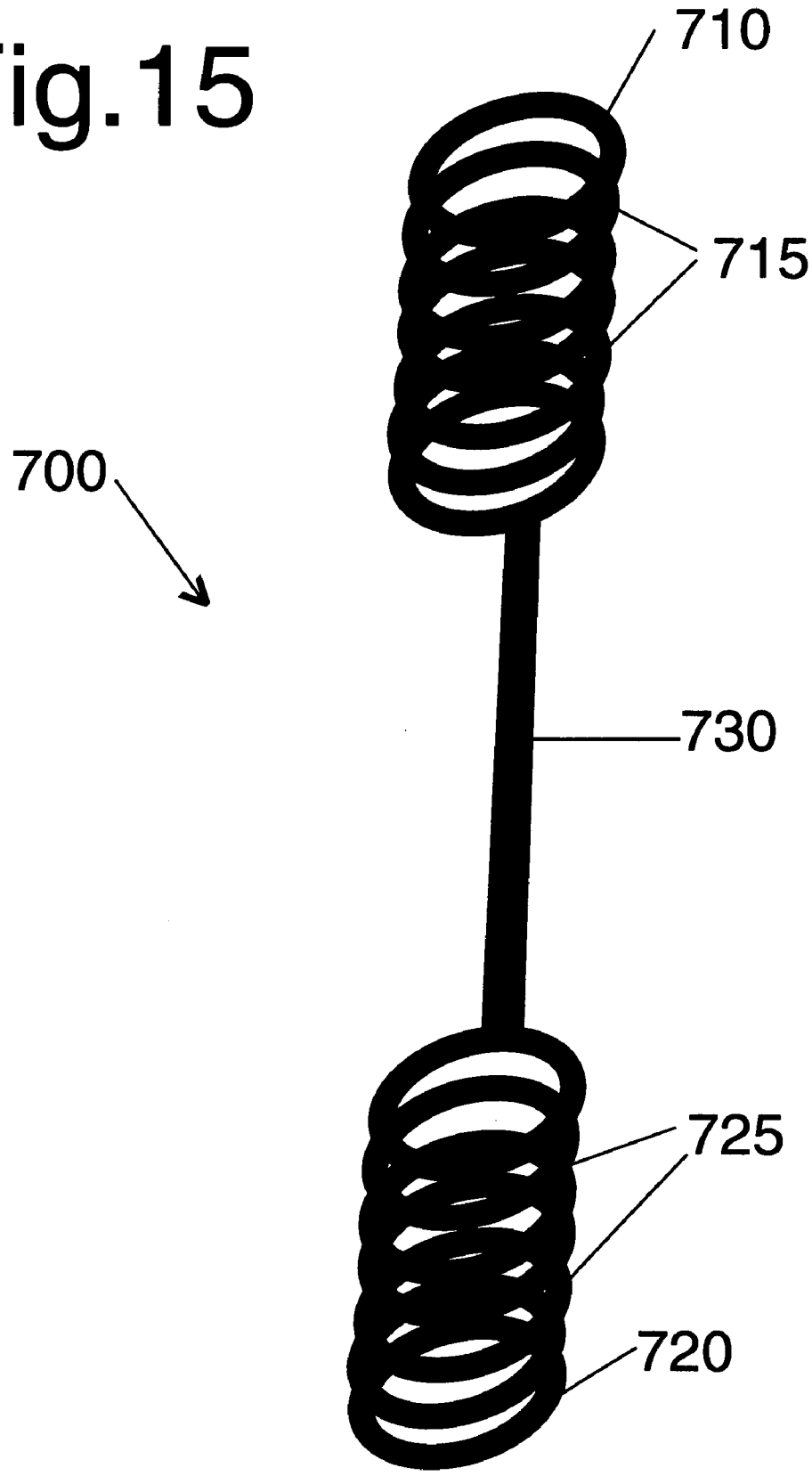
FIG. 15 is a perspective view of an eighth preferred embodiment of a locking device having spring shaped ends for locking two interconnected cords together.
Figure 16:
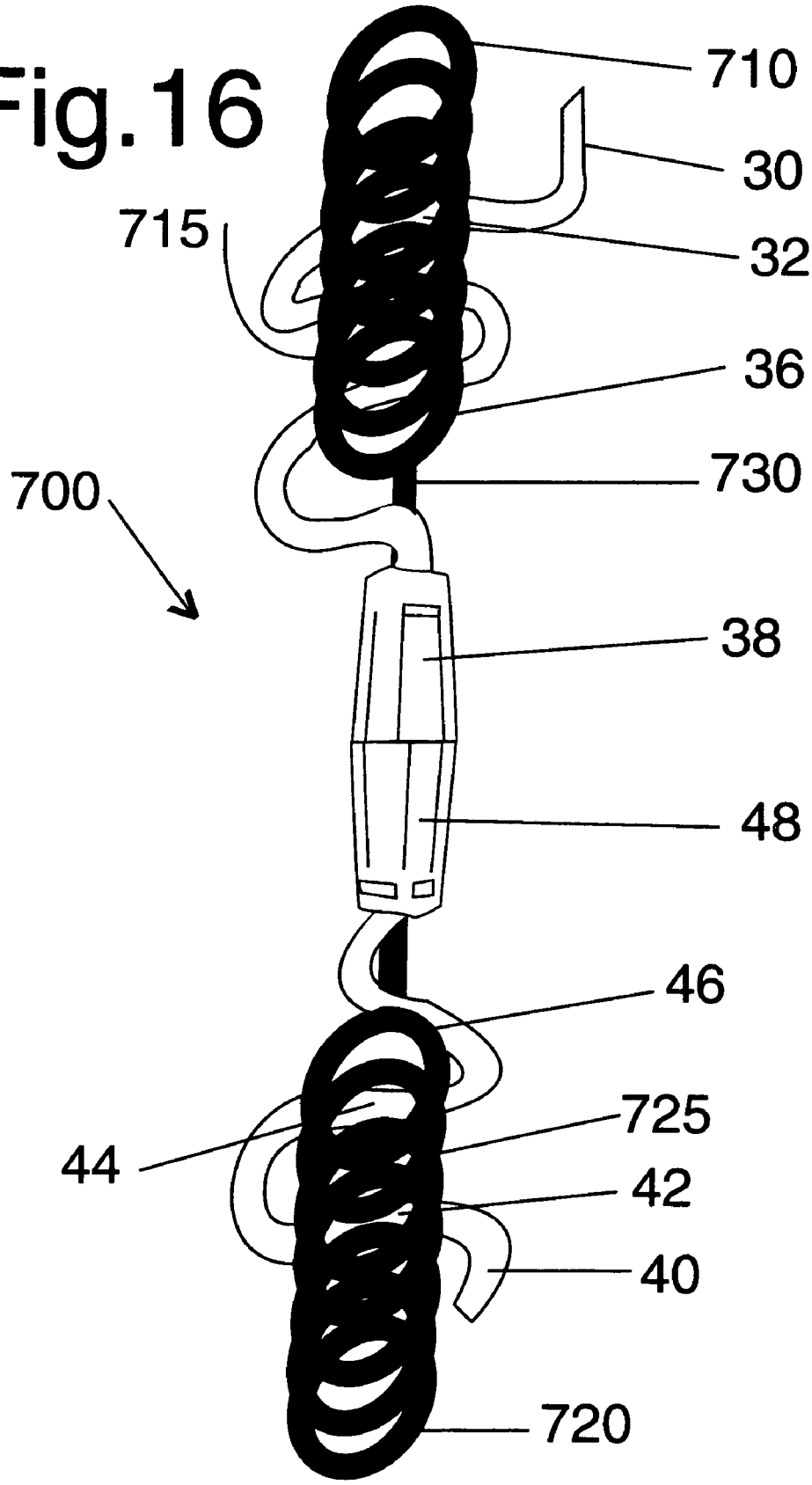
FIG. 16 shows the device of FIG. 15 locking two interconnected cords together.

FIG. 15 is a perspective view of an eighth preferred embodiment of a locking device 700 having ends 710, 730 formed from springs/coils 715, 735 for locking two interconnected cords together in a mid portion 730. The spring shaped ends 710, 730 can be along a single elongated line with the mid-portion being either planar, or wire like. FIG. 16 shows the device 700' of FIG. 15 locking two interconnected cords 30, 40 together. Each cord 30, 40 can have respective cord portions 32, 34, 36 and 42, 44, 46 that are wrapped about different link portions along each of the coils/springs 715, 725, while the interconnected plug/receptacle 38, 48 can be aligned with elongated mid-portion 730. This device can also function and lock similarly to that of the preceding embodiments, where the separate link portions of the coils/springs 715, 725 function similar to the previously described slots.

Figure 17:
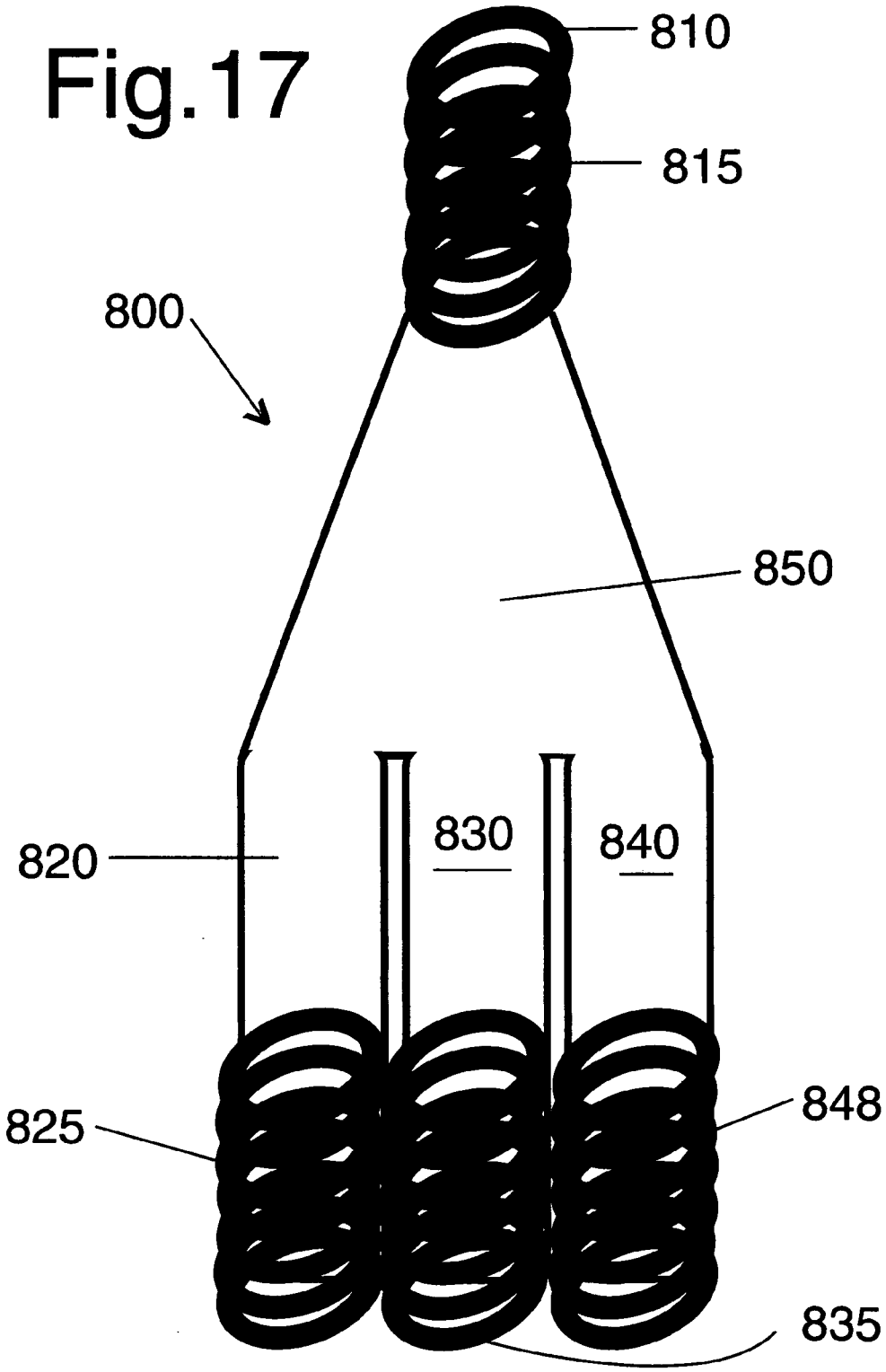
FIG. 17 is a perspective view of a ninth preferred embodiment of a locking device with parallel spring shaped ends opposite a single spring end for locking plural plugs to a single extension cord.

FIG. 17 is a perspective view of a ninth preferred embodiment of a locking device 800 with parallel spring shaped ends 820, 830, 840 opposite a single spring end 810 for locking plural plugs to a single extension cord. The link portions in each respective coils/springs 815, 825, 835, 845 can lock into electrical cord portions similar to the device 700, 700' described in reference to FIGS. 15–16 above. The device 800 can also be used with four electrical cords 30M, 40, 50, and 60 as described in device 400, 400' shown and described in reference to FIGS. 9–10.

Figure 18:
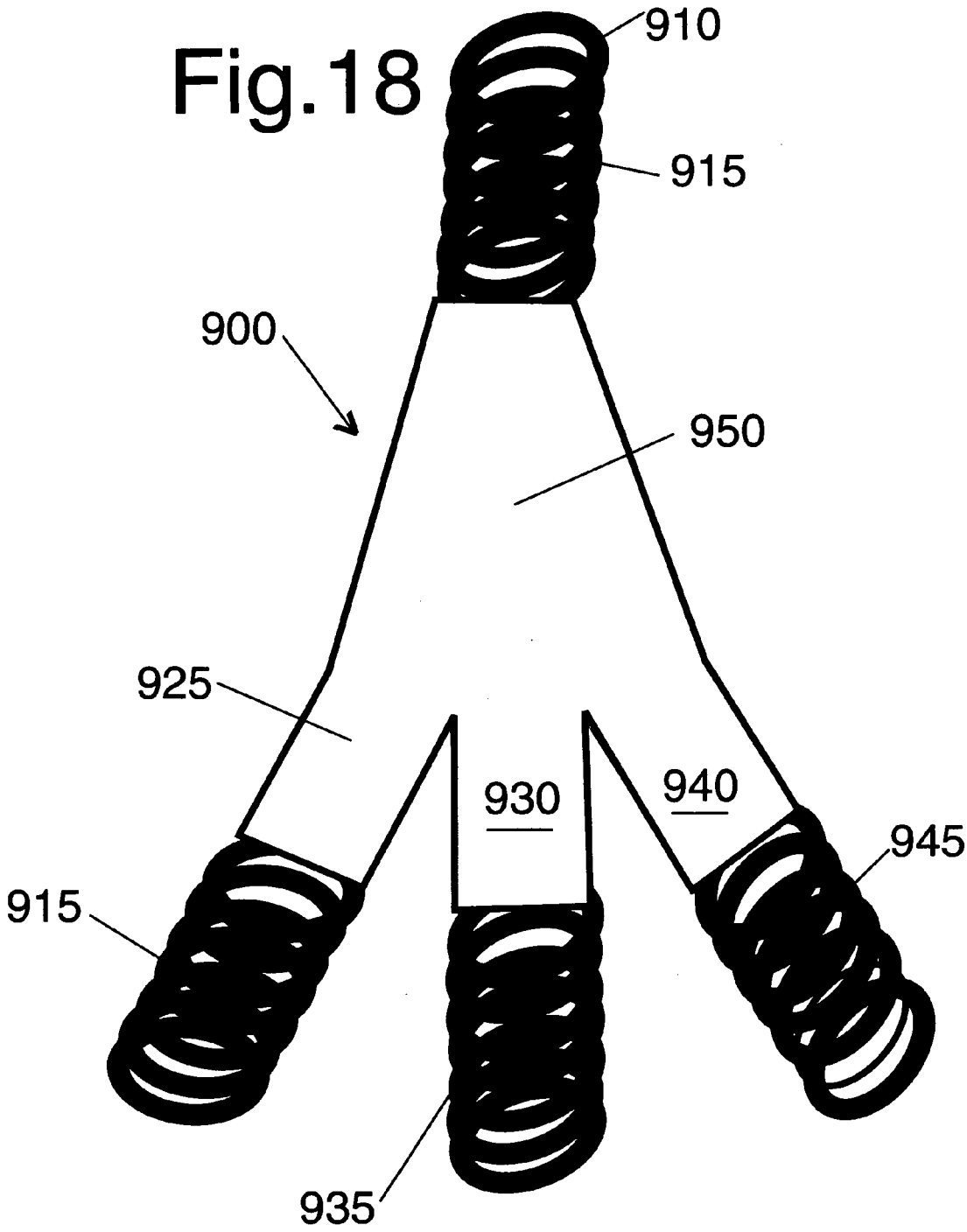
FIG. 18 is a perspective view of a tenth preferred embodiment of a locking device with expanding spring ends opposite a single spring end for locking plural plugs to a single extension cord.

FIG. 18 is a perspective view of a tenth preferred embodiment of a locking device 900 with expanding spring ends 920, 930, 940 opposite a single spring end 910 for locking plural plugs to a single extension cord. The link portions in each respective coils/springs 915, 925, 935, 945 can lock into electrical cord portions similar to the devices 700, 700', 800 described in reference to FIGS. 15–17 above. The device 900 can also be used with four electrical cords 30MT, 40, 50, 60 as described in device 500, 500' shown and described in reference to FIGS. 11–12.

While the invention embodiments describe various shapes of slots, other shapes of the slots can also be used for locking wrapped cords to the devices. Also, the invention can be used with all types and sizes of cords, such as but not limited to flat cords, oval cords, special coated cords(i.e. Teflon coated), and the like.

The invention embodiments can be formed from premolded plastic, PVC, rubber, polyurethane, wood, composite materials, metal, coated metal, layered materials, insulated metal, and the like, combinations thereof, and the like. The devices can come in a wide arrangement of sizes and dimensions as needed.

Although the preferred embodiments describe locking interconnected electrical cords together, the invention can be used to lock other members such as interconnected cable ends, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A locking device for keeping interconnected ends of electrical cords from separating from one another, comprising:

a planar elongated device having a constant width;

a first set of staggered arranged side edge facing slots on one end of the device, the first set of staggered slots including a total of three identically shaped slots with a first slot and a second slot on one side of the one end of the device and a third slot on an opposite side of the one end of the device, for allowing one end of one of the interconnected cords to be wrapped about in an over approximately 360 degree pattern through the first, the second and the third slots; and a second set of staggered side edge facing slots on an opposite end of the device, the second set of staggered slots including a total of three identically shaped slots with a fourth slot and a fifth slot on one side of the opposite end of the device and a sixth slot on an opposite side of the opposite end of the device for allowing one end of another of the interconnected cords to be wrapped about in an over approximately 360 degree pattern through the fourth, the fifth and the sixth slots; and a solid backing directly underlying and supporting the end of the interconnected cords, wherein pulling the interconnected cords apart causes the wrapped cords to lock into the device preventing the interconnected cords from disconnecting from one another.

2. The locking device of claim 1, wherein the interconnected cords include:

a first electrical cord having a female plug end; and a second electrical cord having a male socket end for receiving the female plug end.

3. The locking device of claim 1, wherein the slots each include:

hook shaped side edge facing slots.

4. The locking device of claim 1, further comprising:

ruler indicia markings along at least one side edge of the device, so that the device is useful as a measuring tool.

5. The locking device of claim 1, wherein the slots each include:

curved shaped side edge facing slots.

6. The locking device of claim 5, wherein the curved shaped interior edged slots have a C-shape with an opening facing to side edges of the device.

7. A method of locking interconnected electrical cords together, comprising the steps of:

providing an elongated planar shaped device having a constant width, a first end and a second end opposite to the first end, the first end having a first set of staggered identically shaped slots, the first set having two slots on one side of the first end and a third slot on the opposite side of the first end, the second end having a second set of staggered identically shaped slots, the second end having two slots on one side of the first end and a third slot on the opposite side of the second end, and a solid planar backing portion located between the first end the second end;

mateably interconnecting one end of the first electrical cord with one end of a second electrical cord;

positioning the interconnected ends of the cords over the solid planar backing portion of the planar shaped devices;

wrapping the one end of the first electrical cord about opposite side facing slots along a the first end of a planar shaped device in an over approximately 360 degree pattern; and wrapping the one end of the second electrical cord about opposite side facing slots along the a second end of the planar shaped device, the second end being opposite the end in an approximately 360 degree pattern; and pulling the first electrical cord and second electrical cord apart causing the first cord and the second cord to lock into the respective slots.

8. The method of claim 7, further comprising the step of:

snapping portions of the first cord and the second cord into narrow slit openings of respective slots, where diameters of the first cord portions and the second cord portions are larger than diameters of the narrow slit openings of the respective slots, so that the first cord and the second cord keeps from falling out of the slots.

9. The method of claim 7, further comprising the step of:

providing ruler markings along at least one edge of the device; and using the device as a measuring tool.

* * * * *